US007210416B1

(12) United States Patent
Grigsby, Jr.

(10) Patent No.: US 7,210,416 B1
(45) **Date of Patent: *May 1, 2007**

(54) FINISHED FLATNOSE-EDGE STRUCTURAL MEMBER AND METHOD

(75) Inventor: John M. Grigsby, Jr., Woodstock, GA (US)

(73) Assignee: North American Container Corporation, Mableton, GA (US)

( * ) Notice: Subject to any disclaimer, the term of this patent is extended or adjusted under 35 U.S.C. 154(b) by 328 days.

This patent is subject to a terminal disclaimer.

(21) Appl. No.: 10/867,131

(22) Filed: Jun. 14, 2004

(51) Int. Cl.
*A47B 43/02* (2006.01)

(52) U.S. Cl. ..... 108/165; 108/180

(58) Field of Classification Search ..... 108/165, 108/180, 157.14, 186, 51.3; 211/186, 189, 211/49.1, 55.4; 312/108, 259, 260; 428/76, 428/182

See application file for complete search history.

(56) References Cited

U.S. PATENT DOCUMENTS 3,472,571 A * 10/1969 Himelreich ..... 312/259
4,519,319 A * 5/1985 Howlett ..... 108/180
5,100,216 A * 3/1992 Enns ..... 312/263
5,454,331 A * 10/1995 Green ..... 108/180
5,520,982 A 5/1996 Grigsby et al.
5,537,936 A * 7/1996 Cordrey ..... 108/51.3
5,669,683 A * 9/1997 Moss et al. ..... 312/259
5,670,238 A 9/1997 Earl et al.
5,674,593 A 10/1997 Earl
6,227,515 B1 * 5/2001 Broyles ..... 108/165
6,532,878 B2 * 3/2003 Tidemann ..... 108/180

OTHER PUBLICATIONS

U.S. Appl. No. 10/866,903, filed Jun. 14, 2004, Grigsby.

* cited by examiner

*Primary Examiner*—Jose V. Chen
(74) *Attorney, Agent, or Firm*—Baker, Donelson, Bearman, Caldwell & Berkowitz, PC

(57) ABSTRACT

A flatnose-edge structural member (12), comprising a laminated body (54) of two opposing sheets (56, 58) defining major planar surfaces sandwiching a corrugated paperboard intermediate layer having opposing sides (66, 68), and one of the major surfaces defining a pair of V-shaped channels (70) having a common side edge (72) extending parallel to the opposing sides, with the laminated body (54) folded along a line defined by the common side edge medial the V-shaped channels, whereby the major planar surface opposing the surface having the channels defines a flatnose edge (14) opposing the aligned sides. A method of making a flatnose-edge structural member is disclosed.

15 Claims, 2 Drawing Sheets

FINISHED FLATNOSE-EDGE STRUCTURAL MEMBER AND METHOD

TECHNICAL FIELD

The present invention relates to structural members used as wood replacement materials for constructing products. More particularly, the present invention relates to structural members having a finished edge for replacement of wood members used in constructing products and methods of making such structural members.

BACKGROUND OF THE INVENTION

Wood members, boards and panels are used as components, supports, and frames in a wide range of products, including containers, furniture and other products. Wood substitute materials are finding an increasing use in such products. U.S. Pat. No. 5,520,928 describes a structural member useful as a wood board substitute. The structural member is formed from a billet made of a plurality of corrugated paperboard sheets laminated together. The billet is cut to width to form the structural members, which may be subsequently cut to form elongate members, planks, boards and other planar structural members useful as a substitute for wood in containers, furniture and other products.

One drawback to the use of the board or structural member cut from the billet described above is the open unfinished edge of the structural member. The unfinished edge shows the flutes of the corrugated paperboard sheets that form the interior of the structural member. For some products (such as containers), the open unfinished edge is satisfactory. However, for products in which the structural member is visible, the open unfinished edge must be covered with a trim piece to provide a neat trim appearance to the structural member. While covering the unfinished edge with a trim piece provides a more attractive ornamental finish to the structural member, there are drawbacks to such. Particularly, the edges between the trim piece and the structural member are typically not smooth and this does not provide a visually satisfactory finish appearance.

Accordingly, there is a need in the art for structural members with a finished edge for use in construction of products. It is to such that the present invention is directed.

BRIEF SUMMARY OF THE PRESENT INVENTION

The present invention meets the need in the art for a structural member with a finished edge, comprising a laminated body of two opposing sheets sandwiching an intermediate layer, the body defining a first major planar surface and an opposing second major planar surface and opposing lateral sides. The body defines a pair of V-shaped channels having a common side edge and open to the first major planar surface and extending parallel to the opposing lateral sides. The body is folded along a line defined by the common edge medial the V-shaped channels to align the opposing sides together, and the second major planar surface defines a finished flatnose edge opposing the aligned sides edges.

Objects, advantages, and features of the invention will become apparent upon a reading of the following detailed description of the present invention in conjunction with the drawings and the appended claims.

DETAILED DESCRIPTION

Figure 1:
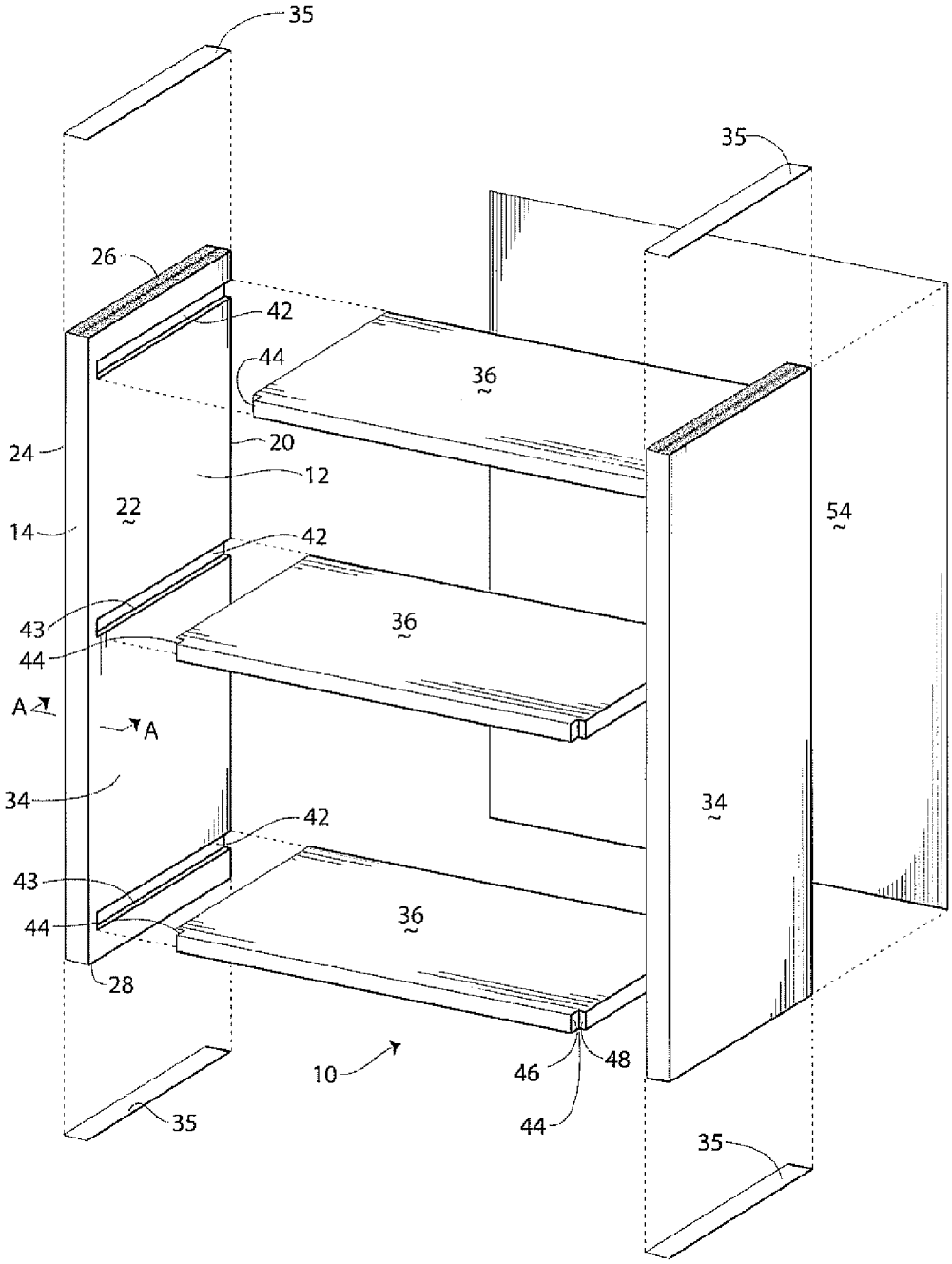
FIG. 1 is a perspective, exploded view of a bookcase assembled with finished flatnose-edge structural members made in accordance with the present invention.

Referring now in more detail to the drawings in which like parts have like identifiers, FIG. 1 illustrates in perspective, exploded view a bookcase 10 assembled with a plurality of finished flatnose-edge structural members 12 made in accordance with the present invention. Each of the finished flatnose-edge structural members 12 includes a flatnose edge face 14 that opposes a back face 20. The structural member 12 has planar opposing side faces 22, 24. The opposing longitudinal ends of the structural member 12 define end faces 26, 28.

The bookcase 10 assembles with a pair of structural members 12 that define opposing side planks 34. The end faces 26, 28 of the side planks 34 are closed by caps 35 having flat or squared opposing ends. The side planks 34 support at least two spaced-apart structural members 12 that define shelf planks 36.

The side planks 34 support the shelf planks 36 in spaced-apart slots 42 defined in the side faces 22 interior of the bookcase 10. The slots 42 extend from the back face 20 towards the opposing front face 14 and terminate short of the front face. The slots 42 are cut a predetermined depth relative to the thickness of the plank 34. The slots 32 each define an interior ledge 43. The slots 42 receive respective ends 26, 28 of the shelf planks 36. The ledges 43 support the edge portion of the shelf plank 16.

Opposing corners between the front face 14 and the ends 26, 28 of the shelf planks 36 define respective notches 44. Each notch 44 has a side face 46 and a recessed front face 48. The side face 46 abuts a portion 50 of the side face 22 between the interior end of the slot 32 and the front face 14. The recessed front face 48 abuts an interior face of the slot 32.

A back panel 54 attaches such as with adhesive to the back faces 20 of the several flatnose structural members 12 used to form the bookcase 10.

Figure 2:
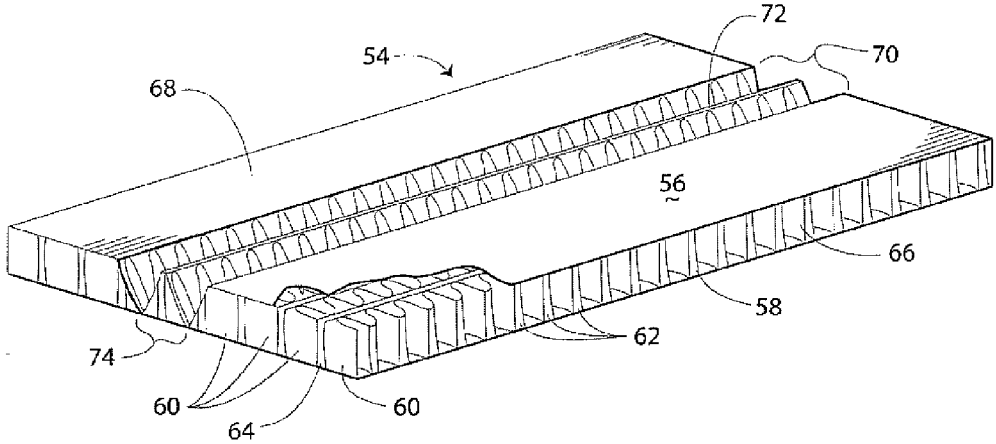
FIG. 2 is a perspective view of a laminated body used to form the finished flatnose-edge structural member according to the present invention.

FIG. 2 is a perspective view of a laminated body 54 that forms the finished flatnose-edge structural member 12 according to the present invention. The laminated body 54 has two opposing sheets 56, 58 that sandwich a plurality of corrugated paperboard sheets 60. The opposing sheets 56, 58 are preferably of finish quality, although the sheets can be fibre board, liner board, or the like. The corrugated paperboard sheets comprise at least a flute layer 62 and a liner board 64. A plurality of the corrugated paperboard sheets 60 are laminated together to define the interior structure of the laminated body 54. The sheets 56, 58 attach such as with adhesive to the opposing sides of the corrugated paperboard sheets 60. The resulting laminated body 54 has opposing sides 66, 68.

The laminated body 54 defines a pair of V-shaped channels 70 that have a common side edge 72. The V-shaped channels 70 extend parallel to the opposing sides 66, 68. The V-shaped channels 70 open to the surface 58 and define a closed opposing portion 74. The flatnose plank 12 is then formed by folding the laminated body along a line defined by the common side edge 72 medial the channels 70 and adhering the opposing planar face portions 56*a*, 56*b* of the sheet 56 together with adhesive. Folding the laminated body 54 causes the portion 74 in the opposing surface 58 to define the finished flatnose edge 14. The back face 20 is defined by the aligned sides 66, 68 upon folding and adhering the opposing surfaces 56*a*, 56*b* of the laminated body 54.

Figure 3:
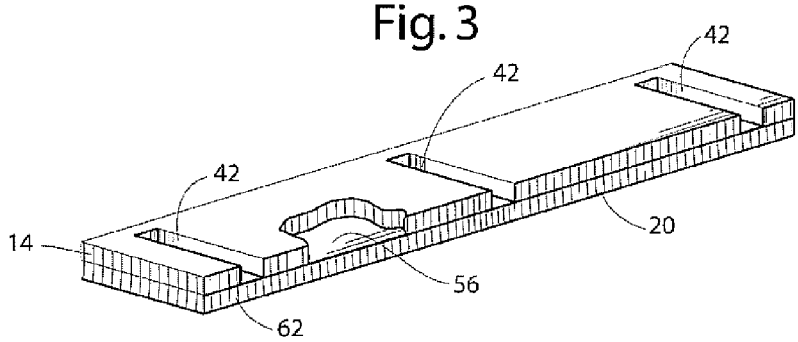
FIG. 3 is a perspective cut-away view of the finished flatnose-edge structural member machined to form a side plank for used in constructing the bookshelf illustrated in FIG. 1.

FIG. 3 is a perspective cut-away view of the flatnose-edge structural member 12 machined to form one of the side planks 34 for use in constructing the bookcase 10. The slots 42 are cut to extend from the back face 20 towards the opposing front face 14 and terminate short of the front face.

Figure 4:
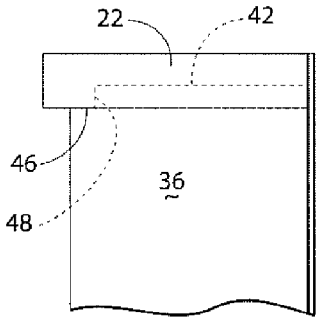
FIG. 4 is top detailed view of a side portion of the bookcase illustrated in FIG. 1.
Figure 5:
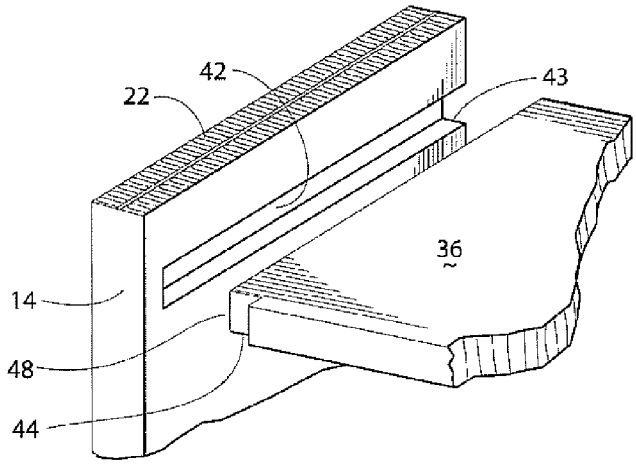
FIG. 5 is perspective exploded view of a side portion of the bookcase illustrated in FIG. 1.

FIG. 4 is top detailed view of a side portion of the bookcase 10 taken along line A—A of FIG. 1 with the shelf panel 36 received in the slot 42. FIG. 5 is perspective exploded view of the side portion of the bookcase 10 taken along line A—A. These views illustrate the mating engagement of the notch 44 of the shelf panel 36 with the distal end of the slot 42 in the side panel 22. The lower interior ledge 52 supports the edge portion of the shelf plank 16.

With reference to FIG. 1, the bookcase 10 assembles by inserting an edge portion of the shelf planks 36 in respective slots 42. Adhesive may be used to fix the shelf planks 36 to the side planks 34. The opposing side plank 34 connects to the opposing edges of the shelf planks 36. The caps 35 attach to the end faces 36, 28 with adhesive. The back panel 54 attaches with adhesive to the back faces 20 of the side planks 34 and the shelf planks 36.

The present invention accordingly provides the finished flatnose-edge structural member readily configured for use in assembly of products that typically require planar wood members, such as in constructing furniture. The principles, preferred embodiments, and modes of operation of the present invention have been described in the foregoing specification. The invention is not to be construed as limited to the particular forms disclosed as these are regarded as illustrative rather than restrictive. Moreover, variations and changes may be made by those skilled in the art without departing from the spirit of the invention described in the following claims.

What is claimed is:

1. A flatnose-edge structural member, comprising a laminated body of two opposing sheets sandwiching an intermediate layer, the body defining a first major planar surface and an opposing second major planar surface and opposing lateral sides, the body defining a pair of V-shaped channels open to the first major surface and having a common side edge and extending parallel to the lateral sides, and the laminated body folded along a line medial the V-shaped channels whereby the second major planar surface defines a flatnose edge opposing an edge defined by the lateral sides that are aligned by the folding of the body.

2. The flatnose-edge structural member as recited in claim 1, wherein the body further defines spaced-apart slots extending from the aligned lateral sides towards the opposing flatnose edge.

3. The flatnose-edge structural member as recited in claim 1, wherein the body further defines opposing notched corners on the flatnose-edge.

4. The flatnose-edge structural member as recited in claim 1, wherein the sheets are fibre board.

5. The flatnose-edge structural member as recited in claim 1, wherein the intermediate layer is corrugated paperboard.

6. The flatnose-edge structural member as recited in claim 5, wherein the intermediate layer comprises a plurality of corrugated paperboard sheets laminated together.

7. The flatnose-edge structural member as recited in claim 1, wherein the channels extend through the intermediate layer to the opposing sheet.

8. A bookcase assembled from a plurality of flatnose-edge structural members, comprising:

two opposing side panels, each defining at least two spaced-apart slots; and at least two shelf planks, each having opposing distal ends received in aligned respective slots of the opposing side panels, the side panels and the shelf panels each comprising a laminated body of two opposing sheets sandwiching an intermediate layer, the body defining a first major planar surface and an opposing second major planar surface and opposing sides, the body defining a pair of V-shaped channels open to the first major planar surface, the channels having a common edge and extending parallel to the opposing sides, and the laminated body folded along a line defined by the common edge, whereby the second major planar surface defines a flatnose-edge opposing an edge defined by the sides that are aligned together by the folding of the body.

9. The bookcase as recited in claim 8, wherein the shelf planks each define opposing notched corners between the edge portion received in the slot of the side panel and the flatnose-edge of the shelf plank.

10. The bookcase as recited in claim 8, wherein the sheets are fibre board.

11. The bookcase as recited in claim 8, wherein the intermediate layer is corrugated paperboard.

12. The bookcase as recited in claim 11, wherein the intermediate layer in each laminated body comprises a plurality of corrugated paperboard sheets laminated together.

13. The bookcase as recited in claim 8, wherein the channels extend through the intermediate layer to the opposing sheet.

14. A method of making a finished flatnose-edge structural member, comprising the steps of:

(a) attaching a first sheet and a second sheet to a pair of opposing major faces of an interior layer to define a laminated body that also has opposing lateral sides;

(b) cutting in the laminated body a pair of V-shaped channels open to the first sheet and having a common edge and extending in the laminated body parallel to the lateral sides; and (c) folding the laminated body along a line defined by the common edge to align the lateral sides together, whereby the second sheet defines a flatnose edge opposing the aligned lateral sides.

15. The method as recited in claim 14, wherein the cutting step (b) cuts the channels through the intermediate layer to the opposing sheet.

* * * * *